US005110110A

United States Patent [19]

Wirz et al.

[11] Patent Number: 5,110,110

[45] Date of Patent: May 5, 1992

[54] LOOSENING BLOWERS FOR SHEET FEEDERS OF SHEET-FED ROTARY PRINTING PRESSES

[75] Inventors: Arno Wirz, Bammental; Dieter Bergmeier, Heidelberg, both of Fed. Rep. of Germany

[73] Assignee: Heidelberger Druckmaschinen AG, Heidelberg, Fed. Rep. of Germany

[21] Appl. No.: 418,396

[22] Filed: Oct. 6, 1989

[30] Foreign Application Priority Data

Oct. 10, 1988 [DE] Fed. Rep. of Germany ..... 3834400

[51] Int. Cl.[5] ..... B65H 3/14

[52] U.S. Cl. ..... 271/98; 271/97; 271/105; 239/587.1; 239/602

[58] Field of Search ..... 271/97, 987, 105, 108; 239/455, 587, 602

[56] References Cited

U.S. PATENT DOCUMENTS

| | | | |
|---|---|---|---|
| 1,460,314 | 6/1923 | Deck | 271/98 |
| 1,865,012 | 6/1932 | Jackson | 239/602 X |
| 2,594,373 | 4/1952 | Watson | 271/105 |
| 3,785,638 | 1/1974 | Beazley | 271/97 X |

FOREIGN PATENT DOCUMENTS

| | | | |
|---|---|---|---|
| 0228550 | 12/1962 | Austria | 239/602 |
| 73315 | 1/1894 | Fed. Rep. of Germany . | |
| 0655405 | 1/1938 | Fed. Rep. of Germany | 271/98 |
| 0849845 | 9/1952 | Fed. Rep. of Germany | 271/98 |
| 1696324 | 4/1955 | Fed. Rep. of Germany . | |
| 1090687 | 10/1960 | Fed. Rep. of Germany | 271/98 |
| 1203801 | 5/1966 | Fed. Rep. of Germany . | |
| 1221244 | 2/1967 | Fed. Rep. of Germany . | |
| 2240161 | 3/1973 | Fed. Rep. of Germany | 271/98 |
| 2217755 | 6/1973 | Fed. Rep. of Germany | 271/105 |
| 3534036 | 3/1987 | Fed. Rep. of Germany | 271/97 |
| 3804087 | 8/1988 | Fed. Rep. of Germany | 271/98 |
| 0581026 | 8/1958 | Italy | 239/455 |
| 0140948 | 6/1987 | Japan | 271/98 |
| 1303215 | 1/1973 | United Kingdom | 271/97 |
| 2204568 | 11/1988 | United Kingdom | 271/98 |

OTHER PUBLICATIONS

Federal Republic of Germany, Publication "Heidelberg News" Mar. 1977, brochure Heidelberg.

Offset CPC, article "Measuring Processing Remote Control".

"Heidelberg News" Apr. 1978 article, Feeding Mechanism and Feeder.

*Primary Examiner*—Robert P. Olszewski
*Assistant Examiner*—James R. Bidwell
*Attorney, Agent, or Firm*—Herbert L. Lerner; Laurence A. Greenberg

[57] ABSTRACT

A sheet feeder of a sheet-fed rotary printing press is provided with loosening blowers having controllable blowing power and being disposed so as to be adjustable in height on a frame of the sheet feeder behind and at the sides of a pile of sheets and including a plurality of fans for directing an air flow against a side face of the pile of sheets, the air flow being adjustable angularly with respect to the side face.

8 Claims, 2 Drawing Sheets

LOOSENING BLOWERS FOR SHEET FEEDERS OF SHEET-FED ROTARY PRINTING PRESSES

The invention relates to loosening blowers for sheet feeders of sheet-fed rotary printing presses, the loosening blowers having controllable blowing power and being disposed so as to be adjustable in height on a frame of the sheet feeder behind and at the sides of a pile of sheets.

Loosening blowers have become known heretofore which are formed of nozzles which are disposed so as to be adjustable in height, at the level of the upper sheets of a sheet pile, on the suction head of a sheet feeder adjacent to blowers for carrying air when transporting the upper sheet lifted off the pile, the nozzles being supplied with blowing air from a rotary compressor of a standard air system for supplying the suction head with suction air and blowing air. Accordingly, the nozzles of the loosening blowers are supplied with air at a pressure necessary for operation of the suction head and at an appropriately high flow rate. Uncertainties or irregularities in the paper travel of the feeder thus results, particularly in the case of thin papers, foils, statically charged paper and other stocks with comparable properties from the pallet. Loosening blowers of heretofore known construction which include nozzles supplied with air from the standard air system of the suction head are described in the publication "Feeding Mechanism and Feeder", Heidelberg News Apr., pages 7 and 8, from HEIDELBERGER DRUCKMASCHINEN AG, 6900 Heidelberg, Federal Republic of Germany. This publication discloses loosening blowers which are disposed side by side in a horizontal row at the level of the upper sheets of a pile of sheets so as to be adjustable in height, and which are connected in common to the standard air supply of the suction head. Loosening of the upper six to ten sheets of the pile of sheets is thereby achieved. The conventional nozzles are not adjustable and can only be replaced as a complete unit. Because the standard air system of the suction head is designed for optimal functioning of the suckers and of the carrying-air nozzles, it is not possible for additional loosening blowers to be provided.

It is accordingly an object of the invention to provide loosening blowers which offer an improvement in the loosening of the pile of sheets and in the travel of the paper in the feeder, particularly in the case of thin paper from the pallet, foils and the like, the loosening blowers being individually controllable independently of the air-supply system of the printing press and being individually directable towards the pile of sheets.

With the foregoing and other objects in views, there is provided, in accordance with the invention, in a sheet feeder of a sheet-fed rotary printing press, loosening blowers having controllable blowing power and being disposed so as to be adjustable in height on a frame of the sheet feeder behind and at the sides of a pile of sheets, comprising a plurality of fans for directing an air flow against a side face of the pile of sheets, the air flow being adjustable angularly with respect to the side face.

Fans are independent of the standard air system of the printing press because each fan has its own blade wheel with a separate electromotive drive. Fans can therefore be controlled independently of one another in terms of blowing air, and the blowing-air flows thereof can be individually directed at different angular positions against the side faces of the pile of sheets. The number of fans provided is independent of the standard air supply and can, therefore, be increased as desired.

In accordance with other features of the invention, the fans are disposed not only at the rear edge of the pile of sheets in the sheet feeder, but also at both sides of the pile of sheets. Of those fans provided at the sides of the pile of sheets, the upper ones can be adjusted approximately at the level of the carrying-air blowers at the rear edge of the pile of sheets and, from the sides, can blow additional carrying air under the upper sheet lifted off the pile as it is transported in the feeder. This leads, to increase safety in the paper travel, especially when thin paper, foils and comparable stocks are used.

The number of fans to be disposed at the rear edge and at both sides of the pile of sheets perpendicular thereto, the blowing direction thereof and the blowing power thereof are adapted or matched to the respective printing stock. In this regard, the fans may be disposed not only side by side but also vertically above one another, and may blow air against the pile of sheets in order thereby to improve the pre-loosening effect, especially for sheet piles on pallets. The pre-loosening of the pile in lower-lying regions can also facilitate the processing of statically charged papers.

The pre-loosening may also be controlled in cycles by means of a valve. A pivoting action, possibly likewise in time with the operation of the printing press, may be provided by means of a motor, for example with a controlled electric or pneumatic drive.

For the purpose of control, and in accordance with other features of the invention, each fan has a tube-shaped ancillary nozzle formed of elastic material, one end of the nozzle being firmly connected to the fan housing and the other end thereof forming a nozzle cross section, which is adjustable in size and in position with respect to the fan axis. This ancillary nozzle is formed, also in accordance with the invention, from an elastically deformable tube and its free end projects into a clamping device. The clamping device is rotatable about the fan axis and is adjustable in order to regulate the cross section of the nozzle. This results in the formation of a slit for the escape of air from the fan, the slit being rotatable about the blowing direction. The clamping device permits the slit to be made larger or smaller in order to control the speed of the escaping air in addition to the control resulting from a change in the speed of the fan. In this manner, the air flow can be directed at any desired angle to the side face of the pile of sheets. In conjunction with the individually adjustable mounting or suspension of the fan, the air flow may be directed, for example, at an inclination from bottom to top or from rear to front in the travel direction of the sheet. In order to facilitate adjustment, a plurality of fans may be disposed on a common carrier, which is adjustably mounted on guides of the sheeptfeeder frame.

The adjustment of the fan power can be programmed to suit the requirements of specific groups of users, such as label printers, plastics printers, and the like, and can be performed by a common actuating element, with it being possible for such programs to be combined with program adjustments for the overall printing press.

The use of fans in sheet-fed rotary printing presses has become known heretofore, however, fans have been used only in order to press down the printed sheet onto the pile at the sheet delivery.

In accordance with another feature of the invention, the fans are adjustable in height and breadth at a rear edge of the pile of sheets in the sheet feeder and at sides of the pile of sheets extending perpendicularly to the rear edge.

In accordance with an additional feature of the invention, the fans at the rear edge of the pile of sheets as well as the fans disposed at the sides of the pile of sheets which extend perpendicularly to the rear edge of the pile of sheets are in the form of carrying-air blowers for blowing carrying air under upper sheets of the pile as they are transported into the feeder.

In accordance with an added feature of the invention, the fans respectively comprise an ancillary nozzle formed of elastic material and having a cross section adjustable in size and in position with respect to a longitudinal axis of the fan.

In accordance with a further feature of the invention, the ancillary nozzle is formed of a tube and has a free end thereof disposed in a clamping device, the clamping device being rotatable together with the tube about the fan axis and being adjustable for regulating the cross section of the nozzle.

In accordance with again another feature of the invention, there is provided a carrier adjustably mounted on guides of a frame of the sheet feeder, a plurality of the fans being disposed in common on the carrier.

In accordance with again an additional feature of the invention, the fans have respective longitudinal axes with which they are individually adjustable vertically and horizontally with respect to the face of the pile of sheets to which the air flow is directed.

In accordance with a concomitant feature of the invention, the plurality of fans are disposed substantially above one another.

Other features which are considered as characteristic for the invention are set forth in the appended claims.

Although the invention is illustrated and described herein as embodied in loosening blowers for sheet feeders of sheet-fed rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
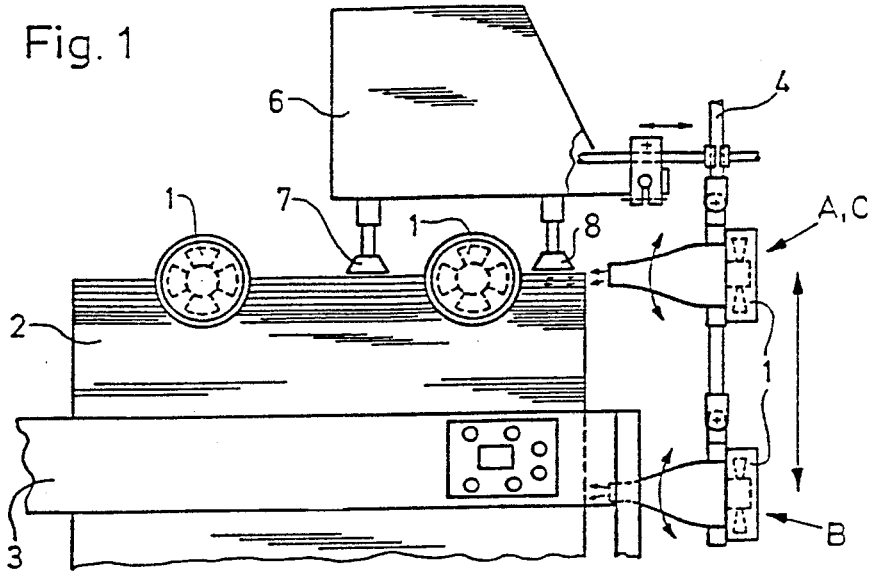
FIG. 1 is a side elevational view of a pile of sheets in a frame of a sheet feeder, only a fragment of the frame being shown for reason of improved clarity.
Figure 2:
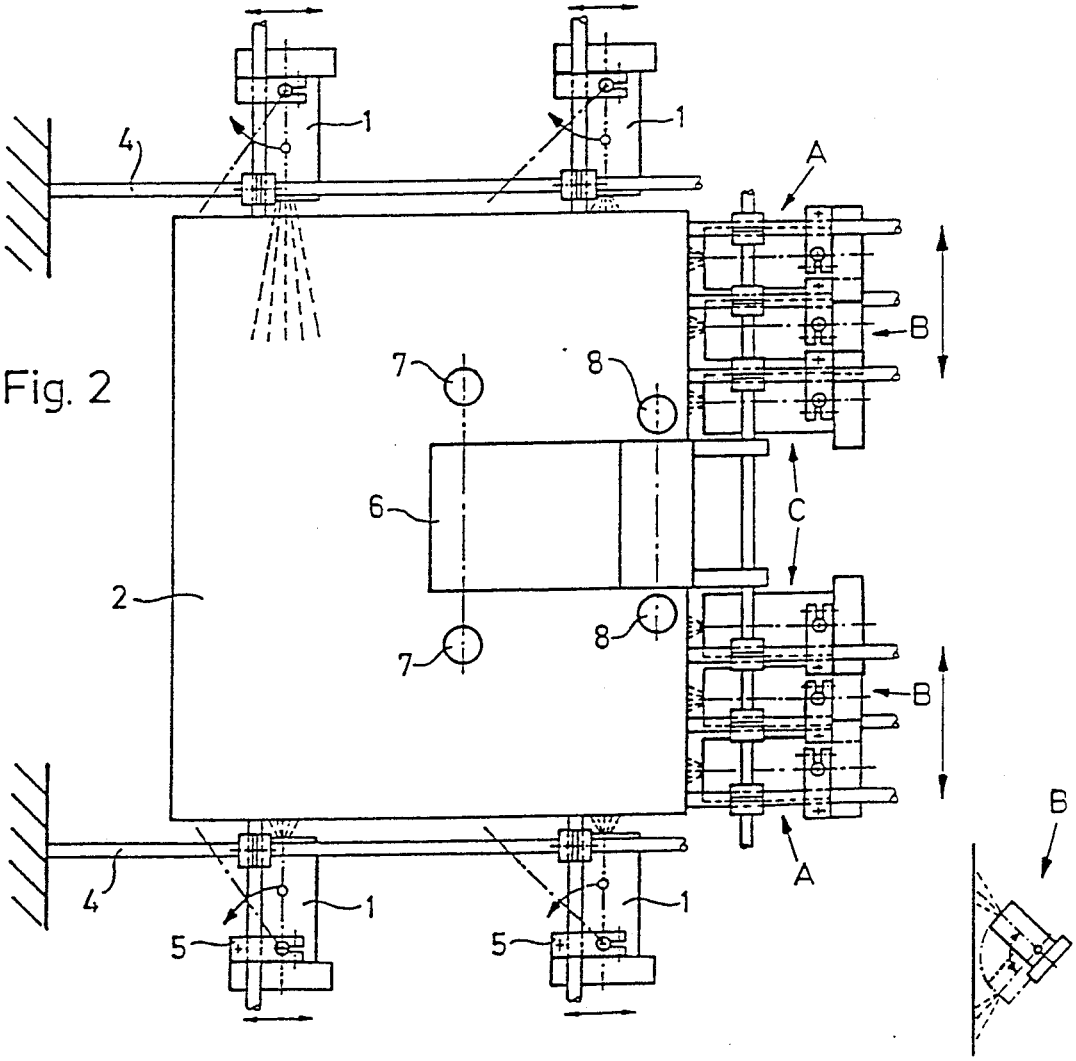
FIG. 2 is a top plan view of FIG. 1.

Referring now to the drawing and, first, particularly to FIGS. 1 and 2 thereof, there is shown therein an arrangement of a plurality of fans 1 serving as loosening blowers at the rear edge of a pile of sheets 2 and at both sides thereof extending perpendicularly to the rear edge. Several of the fans 1 are disposed side by side and, if applicable, also above one another at both the rear edge of the pile of sheets 2 and at the sides of the pile of sheets. Particularly at the rear edge of the pile of sheets, the arrangement of a plurality of fans above one another may result in a considerable improvement in the preloosening of the pile of sheets 2 on the pile table of the feeder. Guides 4 are provided on a frame 3 of the feeder for holding the fans 1 which are individually adjustably mounted on the guides 4 by carriers 5. Arrows shown in FIGS. 1 and 2 illustrate the individual adjustability of the fans 1 in height, in width and about a horizontal axis of the fans 1. The fans disposed at the sides of the pile of sheets 2 are adjustable, furthermore, about a vertical axis and about a horizontal axis in order to direct the air flow of the fans so as to support or reinforce the carrying air in the direction of transport of the upper sheet. Shown schematically in FIGS. 1 and 2 is a suction head 6 with drag-type suckers 7 and lift-type suckers 8.

Figure 3:
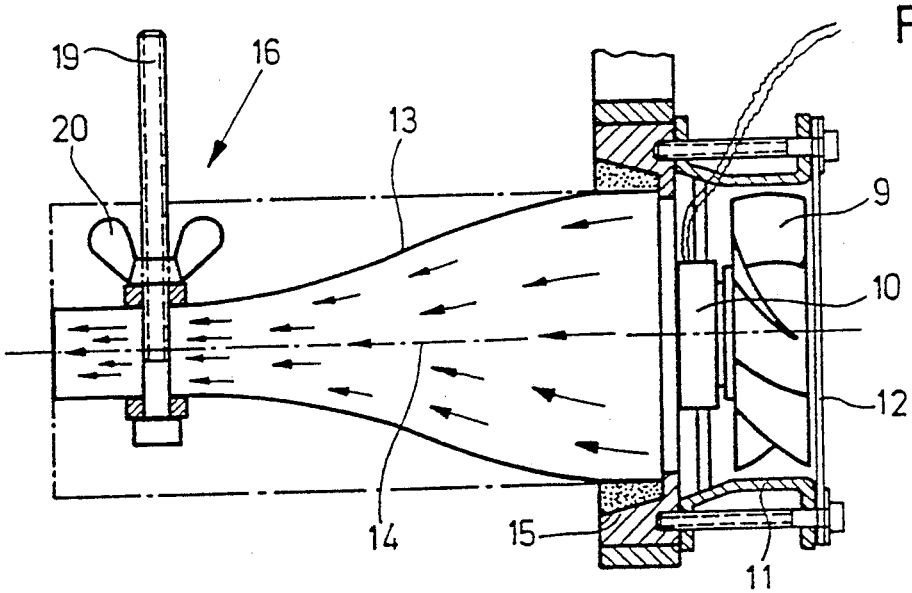
FIG. 3 is an enlarged fragmentary, longitudinal sectional view of FIG. 1 showing a fan with a controllable ancillary nozzle.
Figure 4:
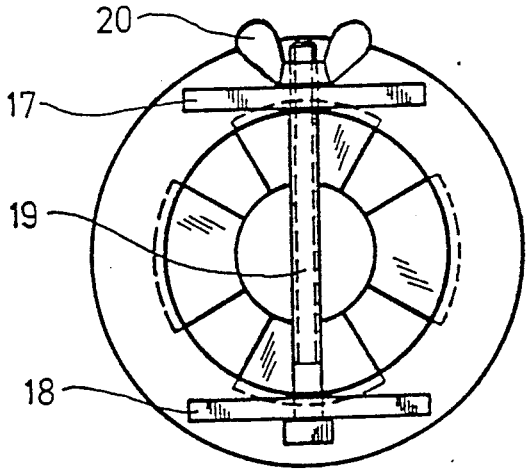
FIG. 4 is a top plan view of the ancillary nozzle with a clamping device in an open state.
Figure 5:
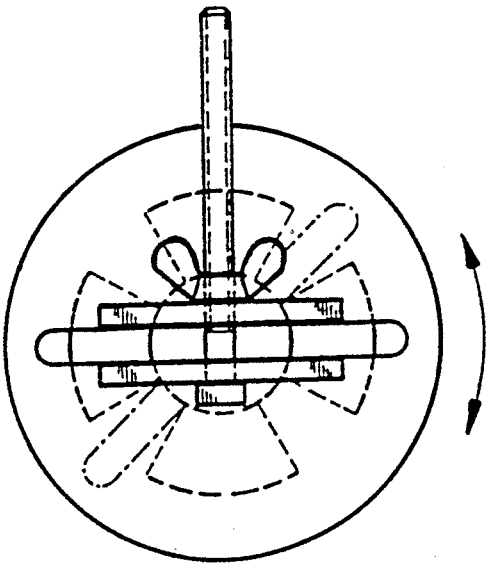
FIG. 5 is a top plan view corresponding to that of FIG. 4, showing the clamping device in a partially closed state.

As shown in FIG. 3, each fan is made up of a blade wheel 9 with a separate electromotive drive 10 in a housing 11, which is closed on the intake side, advantageously, by of a dust filter 12. Tightly connected to the housing 11 on the side thereof opposite to the dust filter 12 is a hose-shaped ancillary nozzle 13 which is nevertheless rotatable about the fan axis 14. The ancillary nozzle 13 is formed of a hose consisting of an elastic material, one end of which is sealingly connected to a connecting part 15 on the housing 11, and the other end of which engages in a clamping device 16 formed of two clamping strips 17 and 18, as shown in FIG. 4 and engaging via a clamping screw 19 with a wing nut 20 which is screwable on the thread of the clamping screw 19. By means of this clamping device 16, it is possible for the cross section of the tube of the ancillary nozzle 13, which is round when in the open state, to be reduced to a flat, compressed opening cross section as shown in FIG. 5 and, if necessary or desirable, closed. The rotatable mounting of the connecting part 15 to the ancillary nozzle 13 permits the adjustment of a flat air flow against the pile of sheets at a specific rotational angle with respect to the axis 14 of the fan.

FIGS. 3 to 5 merely depict diagrammatically one embodiment of the invention for controlling the air flow from the fan. Other control elements for the air flow from a fan are known and may likewise be used.

The foregoing is a description corresponding in substance to German Application P 38 34 400.9, dated Oct. 10, 1988, the International priority of which is being claimed for the instant application, and which is hereby made part of this application. Any material discrepancies between the foregoing specification and the aforementioned corresponding German application are to be resolved in favor of the latter.

What is claimed is:

1. In a sheet feeder of a sheet-fed rotary printing press, loosening blowers having controllable blowing power and being disposed so as to be adjustable in height on a frame of the sheet feeder behind and at the sides of a pile of sheets, comprising a plurality of fans respectively having means individually adjustable for directing an air flow of varying blowing power against a side face of the pile of sheets at a varying angle to the side face.

2. Loosening blowers according to claim 1, wherein said fans are adjustable in height and breadth at a rear edge of the pile of sheets in the sheet feeder and at sides of the pile of sheets extending perpendicularly to the rear edge.

3. Loosening blowers according to claim 2, wherein said fans at the rear edge of the pile of sheets as well as said fans disposed at the sides of the pile of sheets which extend perpendicularly to the rear edge of the pile of sheets are in the form of carrying-air blowers for blowing carrying air under upper sheets of the pile as they are transported into the feeder.

4. Loosening blowers according to claim 1, wherein said fans respectively comprise an ancillary nozzle formed of elastic material and having a cross section adjustable in size and in position with respect to a longitudinal axis of said fan.

5. Loosening blowers according to claim 4, wherein said ancillary nozzle is formed of a tube and has a free end thereof disposed in a clamping device, said clamping device being rotatable together with said tube about said fan axis and being adjustable for regulating the cross section of said nozzle.

6. Loosening blowers according to claim 1, including a carrier adjustably mounted on guides of a frame of the sheet feeder, a plurality of said fans being disposed in common on said carrier.

7. Loosening blowers according to claim 6, wherein said fans have respective longitudinal axes with which they are individually adjustable vertically and horizontally with respect to the face of the pile of sheets to which the air flow is directed.

8. Loosening blowers according to claim 1, wherein said plurality of fans are disposed substantially above one another.

* * * * *